US005156146A

United States Patent [19]

Corces et al.

[11] Patent Number: 5,156,146

[45] Date of Patent: Oct. 20, 1992

[54] WATER-ACTIVATED ANTI-SUFFOCATION PROTECTION APPARATUS

[75] Inventors: Ronald J. Corces, St. Petersburg, Fla.; Roman Jankowiak, Cheektowaga, N.Y.

[73] Assignee: Conax Florida Corporation, St. Petersburg, Fla.

[21] Appl. No.: 759,934

[22] Filed: Sep. 16, 1991

Related U.S. Application Data

[63] Continuation of Ser. No. 507,359, Apr. 9, 1990, abandoned.

[51] Int. Cl.[5] ..... A62B 9/04

[52] U.S. Cl. ..... 128/202.27; 128/201.24; 128/205.25; 128/207.11

[58] Field of Search ..... 128/201.23, 201.24, 128/201.25, 202.27, 204.18, 204.26, 205.25, 206.24, 207.11; 175/1-3.5

[56] References Cited

U.S. PATENT DOCUMENTS

| | | | |
|---|---|---|---|
| 1,814,506 | 7/1931 | Davis | 128/205.17 |
| 2,381,929 | 8/1945 | Schlumberger | 175/2 |
| 2,852,023 | 9/1958 | Hamilton et al. | 128/203 |
| 2,883,931 | 4/1959 | Houck et al. | 175/2 |
| 3,123,831 | 3/1964 | Wells et al. | 128/201.23 |
| 3,473,166 | 10/1969 | Lobelle | 128/201.24 |
| 3,976,063 | 8/1976 | Henneman et al. | 128/142.7 |
| 4,019,507 | 4/1977 | Oetjen et al. | 128/142 R |
| 4,024,440 | 5/1977 | Miller | 361/251 |
| 4,440,163 | 4/1984 | Spergel | 128/205.13 |
| 4,488,546 | 12/1984 | Bernhardt et al. | 128/201.23 |
| 4,763,077 | 8/1988 | Miller | 324/439 |
| 4,803,980 | 2/1989 | Nowakowski et al. | 128/202.27 |

FOREIGN PATENT DOCUMENTS 991255 5/1965 United Kingdom .

*Primary Examiner*—Edgar S. Burr
*Assistant Examiner*—Aaron J. Lewis
*Attorney, Agent, or Firm*—Hodgson, Russ, Andrews, Woods & Goodyear

[57] ABSTRACT

Apparatus for forming an aperture, upon the occurrence of a predetermined event, in a resilient membrane such as a breathing hose, which is attached to a breathing mask worn by a person and which is partially filled with water due to immersion in the water followed emergence of a portion of the hose adjacent the breathing mask from the water, to enable the person to breathe ambient air through the aperture. The apparatus includes a blade, a primer for impelling the blade under explosive force into the resilient member, and a circuit responsive to the occurrence of the predetermined event for firing the primer.

18 Claims, 3 Drawing Sheets

Fig. 3.
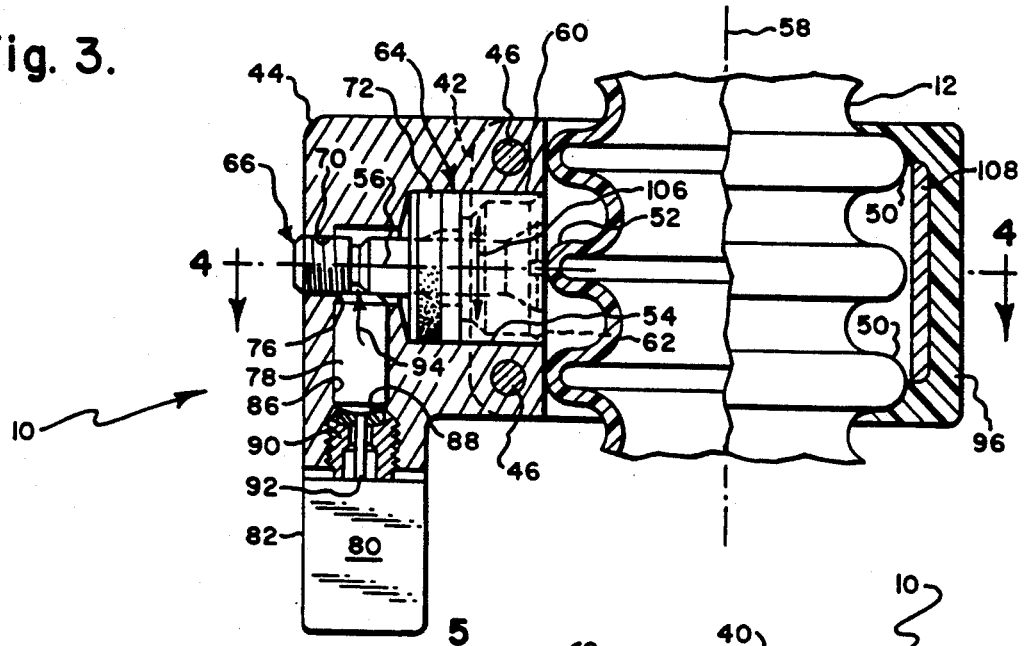
Fig. 4.
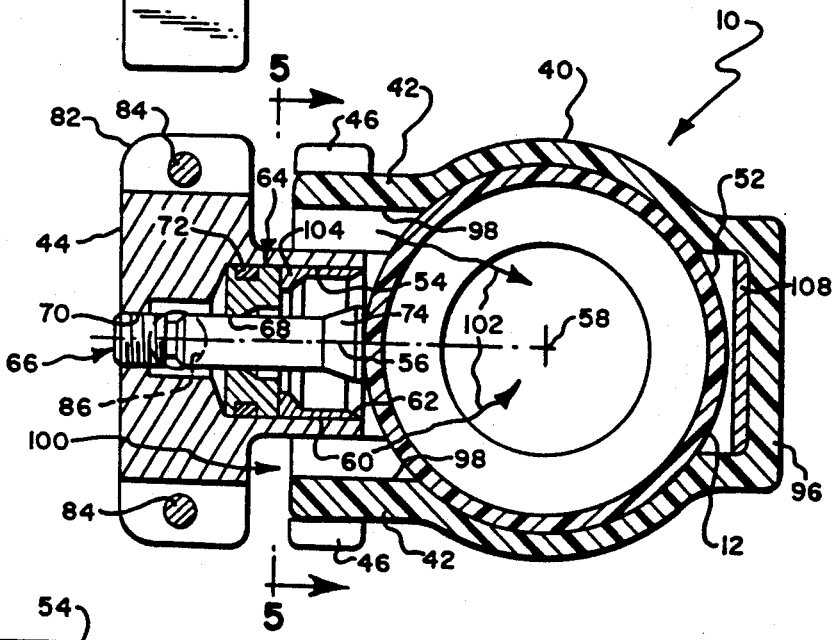
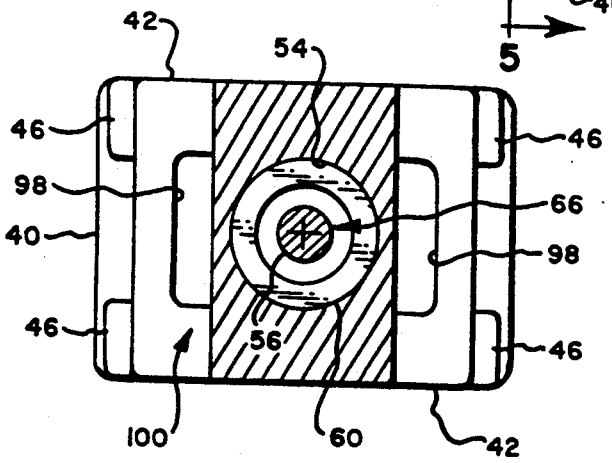
Fig. 5.

WATER-ACTIVATED ANTI-SUFFOCATION PROTECTION APPARATUS

This is a continuation of copending application Ser. No. 07/507,359 filed on Apr. 9, 1990, now abandoned.

The present invention relates generally to apparatus for automatically puncturing a resilient member upon the occurrence of a predetermined event. More specifically, the present invention relates to an explosively actuated mechanism automatically operable upon the occurrence of a predetermined event to provide an aperture in a resilient member such as a breathing hose attached to a breathing mask to enable the wearer to breathe ambient air through the aperture upon the occurrence of a predetermined event.

Pilots and other aircraft crew members customarily are provided with breathing masks/protective helmet arrangements wherein the mask is secured to the helmet in a manner positioning the mask snugly against the face of the user. Breathing gas is supplied to the interior of the mask through a hose connected at one end to the mask and having its other end connected through a quick-disconnect coupling to a source of breathing fluid carried by the aircraft. Upon ejection of the aviator from the aircraft, the hose is released from its source connection and remains attached to the mask as the aviator descends. This presents a potential problem if the aviator descends into water because of the need to separate the mask from his face. While the manual release mechanism presumably will remain operative, often the aviator will be unconscious or injured and unable to manually release the mask. Since the breathing hose will have filled with water, breathing through the mask will cause the person to inhale water and shortly drown as long as the water blocks the entrance of ambient air to the mask.

For some breathing masks, this problem may be solved by the use of an automatic breathing mask release system wherein an explosively actuated mechanism is automatically operable upon descent of the person to a body of water to insure the release of the breathing mask from the protective helmet sufficiently to enable the user to breathe the ambient atmosphere independently of the mask, such as disclosed in U.S. Pat. No. 4,803,980 to Donald E. Nowakowski and Carlton W. Naab and assigned to the assignee of the present invention, which patent is hereby incorporated herein by reference.

While the invention of the aforesaid patent is a useful means of protecting an individual after surfacing who is wearing a breathing mask/protective helmet which has a quick-disconnect and for which it is feasible to provide such an automatic breathing mask release mechanism as disclosed in the aforesaid patent to Nowakowski et al, breathing masks may nevertheless be provided which are attached to the protective helmets in such a way that it is not feasible to provide an automatic breathing mask release mechanism. For example, in chemical or biological warfare defense systems which aid the aircraft crew while exposed to a severe chemical or biological warfare environment, it may be necessary to secure the breathing mask to the protective helmet in such a way that the automatic breathing mask release mechanism of the Nowakowski et al patent may not be usable. It is desirable in such a case to provide an automatic means which will permit the wearer of the breathing mask to breathe after descending into the water and thereafter reaching the surface of the water even though the breathing hose is still attached to the breathing mask and contains water.

Accordingly, it is an object of the present invention to provide an apparatus which is automatically operable to allow breathing of ambient air by the wearer of a breathing mask which is attached to a breathing hose which contains water blocking the inlet of air from the end of the breathing hose after the wearer has been immersed in water and has emerged to the surface.

It is another object of the present invention to accomplish the foregoing in a manner requiring minimal modification of mask mounting arrangements currently in use thereby enabling retrofitting of existing mask/helmet assemblies and permitting the use of masks and helmets of existing approved design.

It is yet another object of the present invention to provide such an apparatus which is rugged, non-complex, highly dependable, and compatible with the environment of its intended use.

In order to achieve the above and other objects of the present invention as described hereinafter, there is provided, in accordance with one aspect of the present invention, apparatus for providing an aperture in a breathing hose attached to a breathing mask to enable the wearer of the breathing mask to breathe ambient air through the aperture upon the occurrence of a predetermined event such as emergence from water after being immersed in the water. An explosively actuated means is provided for impelling a blade into a portion of the hose to form the aperture. Means responsive to the occurrence of the predetermined event is provided for firing the explosively actuated means. Thus, the forming of the aperture in the breathing hose to provide an inlet for ambient air may be said to be analogous to the performance of a tracheotomy on the throat of a person who is choking because his air passage is blocked.

BRIEF DESCRIPTION OF THE DRAWINGS

FIG. 3 is an elevational sectional view of the apparatus of FIG. 2;

FIG. 4 is a sectional view of the apparatus of FIG. 3 taken along the lines 4—4 thereof;

FIG. 5 is a sectional view of the apparatus of FIG. 4 taken along lines 5—5 thereof.

DETAILED DESCRIPTION OF THE PREFERRED EMBODIMENTS

Figure 1:
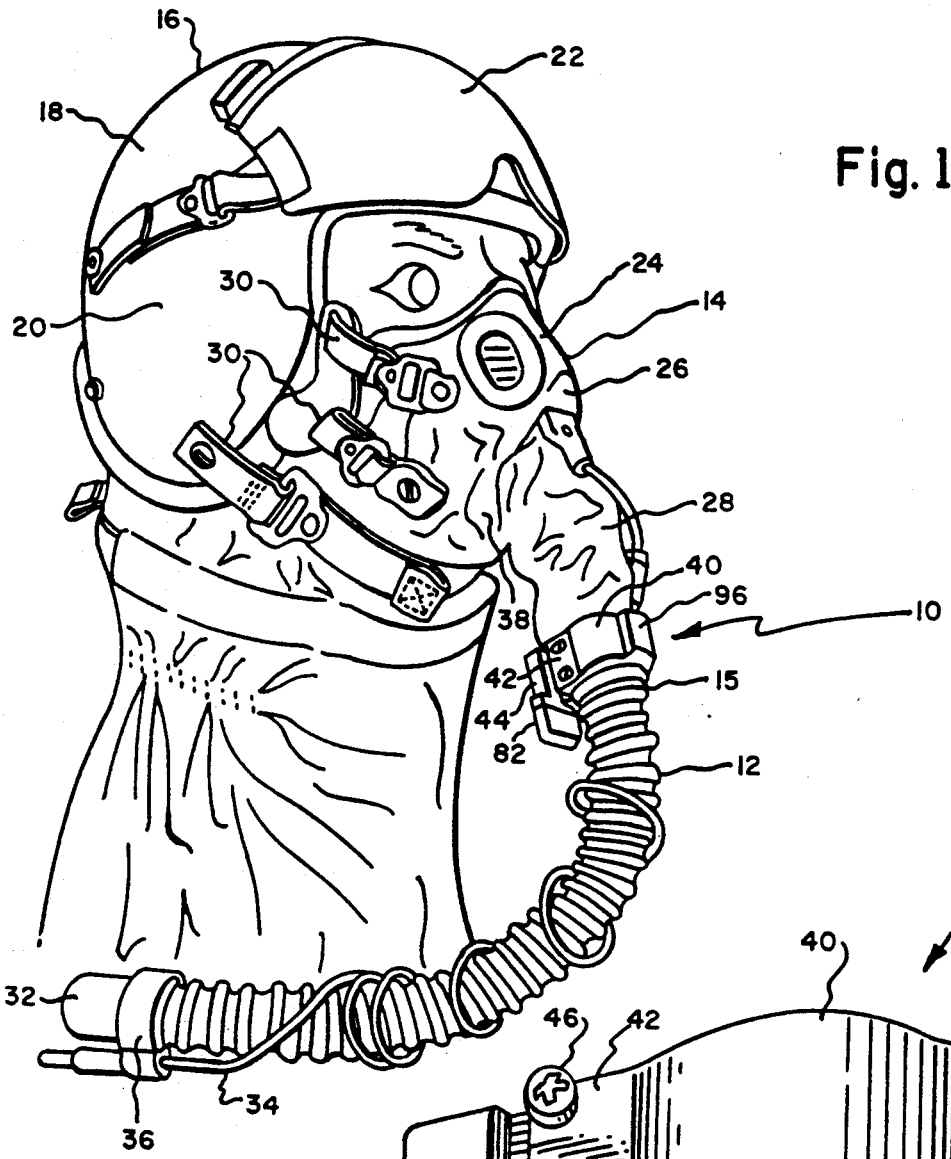
FIG. 1 is an elevational view showing a breathing mask connected to an aviator's helmet in a manner positioning the mask against the face of the user and breathing hose extending from the mask, apparatus which embodies the present invention being shown attached to the breathing hose.
Figure 2:
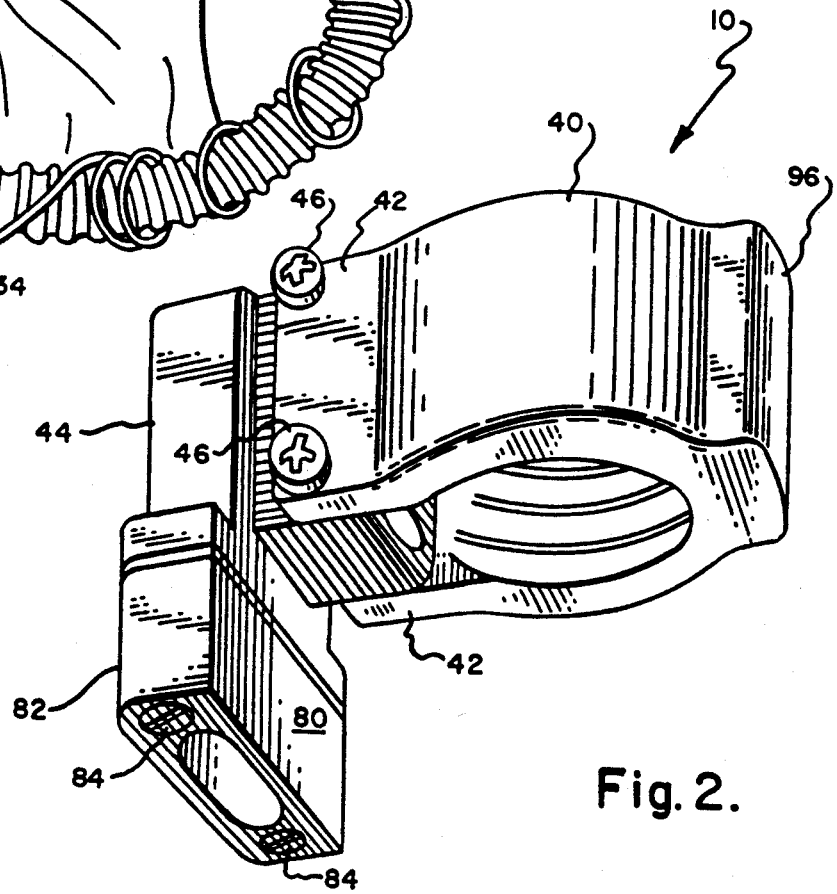
FIG. 2 is a perspective view of apparatus which embodies the present invention.

Referring to FIG. 1, there is illustrated at 10 apparatus which embodies the present invention attached to a breathing hose 12 one end 15 of which is attached to an aviator's breathing mask 14 which is in turn attached to a helmet 16. The helmet 16 comprises a shell 18 having an ear-cover portion 20 on each side and a visor 22 which is movable to and from a retracted position beneath a cover (not shown). The breathing mask 14 comprises a body 24 shaped to fit over the mouth and nose of the aviator's face and includes a nose piece formation 26 in the upper region of the mask body 24 and an inlet formation 28 in the lower region thereof. The mask 14 is securely attached to helmet 16 by means of straps 30 in a way so as to protect the wearer from the effects of chemical and biological warfare and, as a result, it may not be considered feasible to incorporate the automatic breathing mask release mechanism of the aforesaid Nowakowski et al patent therein. Thus, the mask 14 may remain attached to the helmet 16 if the wearer is unconscious and cannot remove it after emergence from water.

Mask inlet 28 is in fluid communication with one end 15 of hose 12 for supplying breathing gas to the interior of the mask 14. Normally, hose 12 is connected at its other end 32 through a quick-disconnect coupling (not shown) to a source of breathing gas in the aircraft, such as a tank (not shown). When the pilot is ejected from the aircraft during an emergency, the end 32 of hose 12, as shown in FIG. 1, is disconnected from the tank, and the length of hose 12 remains connected at its other end 15 to mask 14 and travels with the pilot as he descends by parachute. A cable 34 is connected to hose 12 by a clamp 36 and leads at one end into mask 14 and comprises a plurality of conductors for electrical connection to a microphone (not shown) in mask 14 and earphone (not shown) in helmet 16. The other end of cable 34 normally is connected to communication equipment in the aircraft and is disconnected therefrom when the pilot ejects and travels with him as he descends by parachute. The mask 14 also includes an exhaust outlet 38 in the lower portion thereof which is provided with a check valve (not shown) through which the pilot expels air.

If a pilot remains conscious after ejecting from an aircraft and landing in water, he may unbuckle the straps 30 and remove the hose 12 and mask 14 in order to breathe after emerging to the top of the water. During immersion in the water, the hose 12 will be filled with water through its open end 32 thereby blocking the passage of ambient air to the pilot. Retaining the mask integrity during an extended immersion in water is preferred in that it may afford the user the additional protection of the mask 14 sealing the oral/nasal area from water for a greater period of time. Upon emergence to the surface, the hose 12 may remain partially in the water and partially filled in the portion adjacent the open end 32, even though the pilot may be provided with other apparatus which places him in a position with the mask 14 and adjacent portion of hose 12 out of the water, thus blocking the passage of ambient air to the pilot. As previously stated, if the pilot is conscious, he can remove the mask 14 and hose 12 to permit ambient air to reach his nose. However, if he is unconscious, he will suffocate if some means is not automatically provided which allows a passage of ambient air to his nose.

In order to provide such a passage, in accordance with the present invention apparatus 10 is attached to the hose 12 on the portion thereof which attaches to the mask 14, preferably as close to the end 15 which attaches to the mask 14 as possible to be closely adjacent the mask 14, to cut or puncture a hole or aperture in the hose 12 through which ambient air can enter and pass into the mask 14 for breathing by the wearer.

Referring to FIGS. 2 to 5, apparatus 10 includes a body portion 40 in the form of a collar adapted to fit around the breathing or oxygen-intake hose 12. The collar 40 extends over an arc of circumference of about 270 to 300 degrees with the arc terminating in a pair of spaced parallel portions 42. The collar 40 is clamped in position about hose 12 and attached to housing 44 by suitable means such as a pair of machine screws 46 which are received in threaded apertures (not shown) in the housing 44 to mount each portion 42 to the housing 44. Alternatively, a pair of machine screws may be provided which extend entirely through both portions 42 and the housing 44 and are received in lock nuts. The inner surface of the collar 40 is shaped to conform to the shape of the outer surface of the hose 12, i.e., the inner surface of the collar 40 is shaped to conform to or embrace two hose convolutions 50 on opposite sides of an intermediate convolution 52. It should be understood, however, that the collar 40 may be sized to embrace a different number of convolutions as may be suitable.

There is provided in the housing 44 a bore 54 which extends parallel to the collar portions 42 and which extends in a direction radially of the collar 40 and hose 12, i.e., the bore axis 56 is perpendicular to the axis 58 of the collar 40 and of the hose 12 when the apparatus 10 is installed thereon. A cutting member 60 comprising a thin cylindrical portion terminating in a circular blade 62, which may be stone sharpened, is interference fit or otherwise suitably fitted in the bore 54 with the blade 62 facing the open end of the bore 54 and thus facing the hose 12 when the apparatus 10 is installed on the hose for cutting an aperture therein as will be described in greater detail hereinafter. The space between the parallel collar portions 42 allows the bore 54 to be open to hose 12 so that there are no obstructions to penetration of the hose 12 by the cutting blade 62 when the apparatus 10 is operated. The cutting member 60 may be composed of any suitable material such as, for example, a hardened stainless steel alloy. The housing 44 is composed of a suitable material such as, for example, aluminum alloy casting anodized for corrosion protection which is electrically conductive to act suitably as an electrode for purposes which will be described hereinafter. The collar 40 is composed of a suitable material which is compatible with the hose material such as, for example, black noryl molding or other suitable plastic.

A ram or piston 64, composed of aluminum or other suitable material, is provided in the bore 54 back of the cutting member 60 and in contact therewith for purpose of impelling the cutting member 60 into the hose 12 upon an explosive force being applied thereto as hereinafter described. A piston retaining bolt 66, composed of stainless steel or other suitable material, is received in a central aperture 68 of the piston 64 and is threadedly received in a threaded aperture 70 at the bottom of the bore 54. A fluorocarbon O-ring 72 or other suitable means is provided in the circumferential outer surface of the piston 64 to provide gastight engagement between the piston 64 and housing 44 upon an explosive force being applied to the piston 64 as hereinafter described. The bolt 66 extends below piston 64 and along the length of the cutting member 60 to terminate just short of the hose 12. The bolt 66 has head portion 74 which is suitably shaped to receive and restrain the piston 64 from further movement after it has impelled cutting member 60 into the hose 12. The cutting member 60 terminates at the end opposite the blade in an enlarged portion 104 which has an inner diameter 106 which is larger than the outer diameter of the bolt head 74 so that the cutting member 60 may clear the bolt head when impelled by the piston 64, the enlarged portion 104 of the cutting member 60 permitting positive engagement of the cutting member 60 by the piston 64. Cutting member 60 may have an outer diameter of perhaps 0.0005 to 0.0010 inch larger than the bore 54 so that it may be press fit therein. The cutting member 60 may however be provided with a slightly smaller outer diameter in the enlarged portion 104 thereof so that only the portion thereof which contains the blade 62 need be required to be press fit in the bore.

A passage 76 extends in a direction perpendicular to the bore axis 56 and communicates with bore 54 for flow of explosive gaseous products from passage 76 into bore 54 behind the piston 64. Passage 76 communicates with and is an extension of chamber 86 which contains a suitable explosive-shock type primer or explosive cartridge 78 which is fired by a water-activated sensor 80 as will be discussed hereinafter. The sensor 80 is contained within a housing 82 which is attached to housing 44 by suitable means such as screws 84 and which may be composed of a high-impact thermoplastic material with EMI shielding protection or of other suitable material.

The primer 78 is provided to provide a driving force for piston 64 so that it may impel cutting member 60 into the hose 12 with such rapidity that it will cut an aperture therein. At the opposite end from the passage 76, which routes primer explosive gases into the bore 54, the primer chamber 86 is closed by a suitable sealing means such as O-ring 88 providing gastight engagement between the primer 78 and a plug 90 threadedly engaged within the housing 44 adjacent the end of the chamber 86.

Explosive cartridge 78 may be like the cartridge provided in U.S. Pat. No. 4,024,440 to Miller, which is assigned to the assignee of the present invention and which is incorporated herein by reference. A conduit 92 containing a suitable energizing conductor connected to an activating circuit including sensor circuit 80 contained within housing 82, passes through the O-ring 88 and a central aperture in the plug 90 (from which it is suitably insulated) for firing the primer charge 78. The activating circuit 80 acts in response to the occurrence of a predetermined event to electrically trigger in a conventional fashion by means of the conductor in conduit 92, the explosive cartridge 78, detonating it and thereby generating high pressure gases which pass immediately through passage 76, as illustrated at 94, into chamber 54 and create an immense inertial shock wave acting upon the piston or ram 64. The extremely high pressure of the gas generated by exploding cartridge 78 drives piston 64 with great force to impel the cutting member 60 into the hose 12 to cut an aperture therein. The primer 78 may be similar to the primers provided by Conax Florida Corporation of St. Petersburg, Fla. to the U.S. government for the following: FLU-8A/P automatic inflators for the U.S. Navy; FLU-9/T automatic inflators for the U.S. Air Force; Conax Aid-Pak automatic inflators; and WAMRS automatic breathing mask release mechanism for the U.S. Air Force.

In order to prevent the apparatus 10 from firing prematurely while the wearer is still under water, the sensor circuit 80, which may be a surface-mount component type or other suitable type, is preferably one which is responsive to immersion of the apparatus 10 in water for activating the circuit so that it fires on emergence of the apparatus from the water so that the aperture is formed in the breathing hose 12 after the apparatus 10 emerges from water in which it has been immersed. In order to achieve such a result, the sensor circuit 80 may be similar to that disclosed in U.S. Pat. No. 4,763,077 to Miller, which patent is assigned to the assignee of the present invention and is incorporated herein by reference. The electrically conductive housing 44 may be one sensor and the other sensor 80 may be carried in the circuit enclosing housing 82. The circuitry may be potted internally with a sensor (not shown) attached to an external surface. Thus, as disclosed in the aforesaid Miller patent, upon immersion in water the circuit is activated so that upon emergence from the water the circuit is caused to fire and detonate explosive charge 78.

Figure 6:
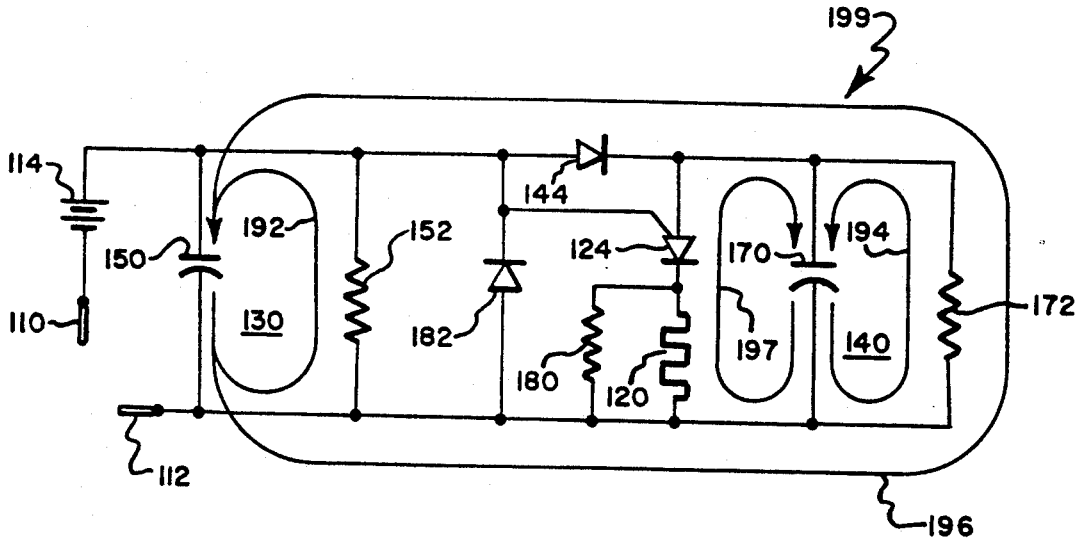
FIG. 6 is a schematic of a sensor circuit that may be used for the apparatus.

An alternative sensor circuit is shown at 199 in FIG. 6 and includes sensing means in the form of a pair of sensing electrodes 110 and 112 and a source of electrical energy in the form of battery 114. While a single battery 114 is shown in the circuit of FIG. 6, two or more batteries can be connected in series to provide the desired voltage. In the circuit shown, the one sensing electrode 110 is connected to the negative terminal of the battery 114. The circuit further includes a load 120, which may be in the form of an electro-explosive device or bridgewire, and a controled switch 124 connected in series with load 120. The load 120 also is connected to the other sensing electrode 112.

Circuit 199 further comprises a first RC circuit branch generally designated 130 connected between the other terminal of the voltage source 114 and the other sensing electrode 112 and a second RC circuit branch designated 140 connected across the series combination of load 120 and controlled switch 124. Circuit 199 also includes control means including a diode 144 operatively connected to the first RC circuit branch 130 and connected in controlling relation to controlled switch 124. When the electrodes 110 and 112 are exposed to a first medium having a predetermined electrical conductivity, voltage builds upon the first and second RC circuit branches 130 and 140 respectively, and the controlled switch is open. Then a predetermined time after the electrodes are exposed to a second medium having a different electrical conductivity, the controlled switch 124 is closed and the load 120 is operated by energy stored in the second RC circuit of branch 140. The predetermined time is established by the difference in the time constants of the RC circuit branches 130 and 140 and may be perhaps 0.3 sec. to be greater than the duration of apparent excursions due to water turbulence or the like at the electrodes 110 and 112 or to avoid unwanted operation of load 120 in response to an apparent change in conductivity such as when the electrodes are first exposed to salt water spray and then become dry such as when the apparatus is stored on the deck of a carrier. In this respect, the magnitudes of capacitor 150 and resister 152 may be selected so that capacitor 150 discharges faster than the electrodes can dry.

The first energy storage branch 130 is in the form of an RC circuit comprising the parallel combination of capacitor 150 and resistor 152. One terminal of capacitor 150 is connected to the positive terminal of voltage source 114, and the other terminal of capacitor 150 is connected to sensing electrode 112. Resistor 152 is connected across capacitor 150. Controlled switch 124 is a thyristor of anode/gate configuration, the cathode of which is connected to one terminal of load 120. The other terminal of load 120 is connected to sensing electrode 112. The anode of thyristor 124 is connected to the cathode of control diode 144, and the gate of thyristor 124 is connected to the anode of diode 144. The anode of control diode 144, in turn, is connected to the junctions of RC circuit 130 and the positive terminal of voltage source 114.

The second energy storage branch 140 is in the form of an RC circuit comprising the parallel combination of capacitor 170 and resistor 172. One terminal of the capacitor 170 is connected to the junction of thyristor 124 and control diode 144, and the other terminal of the capacitor 170 is connected to sensing electrode 112. Resistor 172 is connected across capacitor 170.

A protective resistor 180 is connected across bridgewire 120 for a purpose which will be described. A protective diode 182 is connected across the combination of load 120, thyristor 124, and control diode 144 for static discharge protection which will be described. The anode of protective diode 182 is connected to the junction of load 120 and resistor 180, and the cathode of protective diode 182 is connected to the anode of control diode 144.

The circuit in FIG. 6 operates in the following manner. In response to sensing electrodes 110 and 112 being exposed to a medium or fluid of predetermined conductivity, for example, water, a circuit is completed including electrodes 110 and 112, RC circuit branches 130 and 140, and diode 144. Current flows in the circuit from electrode 110 through the water to electrode 112 then through resistors 152 and 172 and charging capacitors 150 and 170. As current flows, the capacitors collect a charge allowing less and less current flow through the capacitors until a charge voltage close to that of source 114 is obtained in the capacitors. For example, with source 114 being a 6.6 volt battery, capacitors 150 and 170 may each charge up to a voltage of nearly 6.0 volts in about 2 seconds. Since the anode of diode 144 is connected to the positive terminal of source 114, diode 144 remains on or conducting during the charging of capacitors 150 and 170 to a voltage slightly less than the voltage of source 114.

When electrodes 110 and 112 are removed from the water medium and are in air, there is no longer a flow of current between electrodes 110 and 112, and source 114 is functionally removed from the circuit. Capacitors 150 and 170 begin to discharge along the paths designated 192 and 194 respectively. Initially there is flow of current also along path 196. Capacitor 150 has a smaller capacitance as compared to capacitor 170 and as a result capacitor 150 discharges at a rate much faster than that of capacitor 170. After a short time delay, for example, 2 to 3 tenths second, the voltage difference between capacitors 150 and 170, and likewise across diode 144 and across the anode/gate connections of controlled switch 124, is sufficient to turn thyristor 124 on. This allows capacitor 170 to discharge through load 120 along the path designated 197 in FIG. 6. The first and second energy storage branches 130 and 140 respectively may be viewed as providing energy storage means for storing energy when the electrodes 110 and 112 are exposed to the first medium (water) for operating load 120 when the electrodes are exposed to the second medium (air) and providing time delay means for establishing the predetermined time after which load 120 is operated.

Resistor 180 prevents a voltage build-up across the circuit connections to the electro-explosive device 120 when the device is removed during replacement or repair. Otherwise, if such a build-up were allowed to occur, re-connection of device 120 could operate thyristor 124 causing inadvertent firing of device 120.

Diode 182 provides static discharge protection for thyristor 124 in the situation where the top portion of the circuit becomes negative relative to the bottom of the circuit. Diode 182 may be selected to withstand 25 kilovolts static discharge. Thyristor 124 may be of anode/gate configuration to provide enhanced gate sensitivity.

By way of example, in an illustrative circuit, battery 114 comprises the series combination of two 3.3 volt batteries to provide a total output of 6.6 volts, load 120 is an electroexplosive device commercially available from Conax Florida Corporation, Model CC-114 rated 2–5 ohms, thyristor 124 is a Motorola MMBP6027 programmable unijunction transistor, capacitor 150 has a magnitude of 3.3 microfarads, capacitor 170 has a magnitude of 47 microfarads, each of resistors 152 and 172 has a magnitude of 1 megohm and resistor 180 has a magnitude of 1 kilohm.

While a specific circuit has been described, it is to be understood that the invention is not limited to such a circuit and that any suitable means responsive to immersion of the apparatus in water for actuating an explosively actuated means so that it fires upon emergence of the apparatus from the water may be used.

The hose 12 being composed of a resilient material, there is a tendency for the cutting member 60 to collapse the wall portion of the hose which it strikes against the opposite wall portion. In order to support the hose 12 so that its resiliency does not prevent the aperture from being formed, in accordance with a preferred embodiment of the present invention an anvil means such as a thickened and/or hardened portion 96 of the collar 40 is provided circumferentially opposite the bore 54, i.e., lying on the axis 56 of the bore 54 but on the opposite side of the hose 12 therefrom. The anvil member 96 preferably extends generally over the width of the collar 40, is aligned with the bore 54, and is sized to adequately provide backing or support to the blade 62 for cutting the hose 12. A metallic member 108 composed of aluminum or other suitable material and having a thickness of perhaps 1/16 inch is preferably inserted in anvil portion 96 to underlie the hose 12 to provide support for the cutting thereof. Alternatively, the anvil 96 may comprise a separate member bonded or otherwise suitably attached to the collar 40. In accordance with yet another embodiment, the collar 40 may be composed of two identical parts wherein, after metallic member 108 is inserted and spans both collar halves, the identical parts are clamped together by suitable means such as, for example, four prongs on the metallic member 108 which are press fit into two apertures in one collar half and two apertures in the other collar half respectively. The assembled collar is then positioned about the hose 12 and mounted to the housing 44, as previously discussed. Thus, the anvil 96 and more particularly the metallic member 108 thereof permits the cutting of the wall of the hose 12 by the blade 62 after the hose walls have been collapsed against each other by the force of the blade 62 being impelled thereagainst with the anvil 96 providing support thereof. Being resilient, the hose 12 should normally return immediately to its normal shape with the aperture that is cut therein allowing the entrance of air to be breathed.

A pair of air inlets 98 in the housing 44 which are located between the parallel portions 42 repectively and the bore 54 are open to the hose 12 at one end and are open to a space 100 between the ends of the parallel portions 42 and the housing 44 at the other end respectively so as to provide a passageway for air therethrough and between convolutions of the hose 12 after the aperture has been cut therein, as illustrated at 102.

The bore 54, for a typical breathing hose 12 having a diameter of perhaps 1" or 1½", may have a diameter of perhaps ½" to thereby provide an aperture in the hose which has a diameter of ½". The metallic member 108 therefor may accordingly have a diameter of perhaps 0.7 inch.

In order that the apparatus 10 may be armed only under certain predetermined conditions such as immersion in water, the device may be set to arm itself upon the establishment of a suitable conductance between the electrodes such as 119 micromhos so that it functions only upon removal from water after an immersion therein. The device 10 may operate to puncture the oxygen or breathing hose 12 within perhaps 1 second after removal from the water.

In operation, when the pilot ejects and lands in water, the sensor 80 is activated to a firing condition such that, upon emergence from the water, it fires primer 78. This creates an explosive force behind piston 64, driving it forwardly. This in turn drives cutting member 60 toward the adjacent portion of hose 12 with such rapidity and force that the hose is first collapsed and then the blade 62 is driven through the hose wall with the anvil 96 providing support therefor. The resulting aperture allows admission of ambient air through passages 98 in the housing 44. The retainer bolt 66, threadedly engaging the housing at one end and having an enlarged head 74, holds piston 64 within the housing after cutter 60 has been impelled to and through the hose wall. Since it is expected that the pilot at this time will be on the surface of the water, the hose 12 should normally drop downwardly allowing removal by gravity of any water between the aperture formed therein and the mask 14 so that the pilot is able to breathe ambient air therethrough. Thus, there has been provided a water-activated, self-contained, automatic device that will open an aperture in the oxygen intake hose above the water line leading to the mask 14 which does not require crew member or aircraft input for activation and is unaffected by hostile environments such as fog or high humidity for functioning only upon emergence from water after having been immersed in water, has small size and low weight of perhaps less than 60 grams including batteries (not shown) for powering the sensor circuit, and is mountable externally of the oxygen intake hose to eliminate problems of compatibility with different breathing systems and so that no change is required to the standard oxygen hose.

While specific embodiments of the invention have been shown and described in detail to illustrate the application of the principles of the invention, it will be understood that the invention may be embodied otherwise without departing therefrom and that the details herein are therefore to be interpreted as illustrative and not in a limiting sense.

What is claimed is:

1. Apparatus for providing an aperture in a breathing hose attached to a breathing mask to enable a wearer of the breathing mask to breathe ambient air through the aperture upon the occurrence of a predetermined event, the apparatus comprising blade means for cutting an aperture in the hose, means for housing said blade means, explosively actuated means for impelling said blade means into a portion of the hose to form an aperture in the hose, means responsive to the occurrence of the predetermined event for firing said explosively actuated means, and means for attaching said housing means to the hose with said blade means positioned for movement toward the portion of the hose for cutting the aperture therein in response to firing of said explosively actuated means.

2. Apparatus according to claim 1 further comprising anvil means for supporting the hose for cutting thereof by said blade means.

3. Apparatus according to claim 1 wherein said attaching means includes a collar means, a pair of parallel spaced portions on said collar means which are attached to opposite sides of said blade means housing means, and an arcuate portion for extending circumferentially about the hose from one of said parallel portions to the other of said parallel portions to partially surroundingly engage the hose whereby a portion of the hose is free of engagement by the collar means.

4. Apparatus according to claim 3 further comprising anvil means on said collar means arcuate portion circumferentially intermediate said parallel portions for supporting the hose for cutting thereof by said blade means, said anvil means including a thickened portion of said collar means and a metallic insert in said thickened portion for providing support for cutting of the aperture in the hose.

5. Apparatus according to claim 3 wherein said blade means housing means includes chamber means for containing said blade means and positioning said blade means for movement in a direction perpendicular to the hose axis, and piston means in said chamber means for transmitting force to said blade means from said explosively activated means, said chamber means being disposed between said parallel spaced portions whereby the blade means may be impelled into the portion of hose which is free of engagement by the collar means.

6. Apparatus according to claim 5 further comprising anvil means on said collar means arcuate portion circumferentially intermediate said parallel portions for supporting the hose for cutting thereof by said blade means.

7. Apparatus according to claim 6 further comprising passage means in said blade means housing means for routing ambient air to the aperture.

8. Apparatus according to claim 6 further comprising retainer means in said chamber means for retaining said piston means therein.

9. Apparatus for automatically providing an aperture in a breathing hose, which is attached to a breathing mask worn by a person and which is partially filled with water due to immersion in the water, followed by emergence of at least a portion of the hose adjacent the breathing mask from the water, to enable the person to breathe ambient air through the aperture, the apparatus comprising blade means, explosively actuated means for impelling said blade means into the hose to form an aperture, means responsive to emergence of the apparatus from water for firing said explosively actuated means, and means responsive to immersion of the apparatus in water for activating said explosively actuated means so that it fires upon emergence of the apparatus from the water whereby the aperture is formed in the breathing hose after the apparatus is emerged from water in which it has been immersed.

10. Apparatus according to claim 9 further comprising anvil means for supporting the hose for cutting thereof by said blade means.

11. Apparatus according to claim 9 further comprising means for housing said blade means, a collar means, a pair of parallel spaced portions on said collar means which engage and are attached to opposite sides of said blade means housing, and an arcuate portion extending circumferentially about the hose from one of said parallel portions to the other of said parallel portions to partially surroundingly engage the hose whereby a portion of the hose is free of engagement by the collar means.

12. Apparatus according to claim 11 further comprising anvil means on said collar means arcuate portion intermediate said parallel portions for supporting the hose for cutting thereof by said blade means, said anvil means including a thickened portion of said collar means and a metallic insert in said thickened portion for providing support for cutting of the aperture in the hose.

13. Apparatus according to claim 11 wherein said blade means housing means includes chamber means for containing said blade means and positioning said blade means for movement in a direction perpendicular to the hose axis, and piston means in said chamber means for transmitting force to said blade means from said explosively activated means, said chamber means disposed between said parallel spaced portions whereby the blade means may be impelled into the portion of hose which is free of engagement by the collar means.

14. Apparatus according to claim 13 further comprising anvil means on said collar means arcuate portion circumferentially intermediate said parallel portions for supporting the hose for cutting thereof by said blade means.

15. Apparatus according to claim 14 further comprising passage means in said blade housing means for routing ambient air to the aperture.

16. Apparatus according to claim 15 further comprising retainer means in said chamber means for retaining said piston means therein.

17. Apparatus for automatically providing an aperture in a breathing hose, which is attached to a breathing mask worn by a person and which is partially filled with water due to immersion in the water followed by emergence of a portion of the hose adjacent the breathing mask from the water, to enable the person to breathe ambient air through the aperture, the apparatus comprising blade means for cutting an aperture in the hose, housing means including chamber means for containing said blade means, collar means attached to said housing means for partially surroundingly engaging the hose to position said blade means for movement in a direction perpendicular to the axis of the hose for cutting the aperture therein, piston means in said chamber means for transmitting force to said blade means, explosively actuated means for applying force to said piston means for impelling said blade means into the hose to cut an aperture therein, means responsive to emergence of the apparatus from water for firing said explosively actuated means, and means responsive to immersion of the apparatus in water for actuating said explosively actuated means so that it fires upon emergence of the apparatus from the water whereby the aperture is formed in the breathing hose after the apparatus emerges from water in which it has been immersed.

18. Apparatus according to claim 17 further comprising anvil means for supporting the hose for cutting thereof by said blade means.

* * * * *